US009499321B2

(12) United States Patent
Ou

(10) Patent No.: US 9,499,321 B2
(45) Date of Patent: Nov. 22, 2016

(54) DISPLAY BOARD FOR TOOLS

(71) Applicant: Yu-Hua Ou, Taichung (TW)

(72) Inventor: Yu-Hua Ou, Taichung (TW)

( * ) Notice: Subject to any disclaimer, the term of this patent is extended or adjusted under 35 U.S.C. 154(b) by 0 days.

(21) Appl. No.: 14/673,329

(22) Filed: Mar. 30, 2015

(65) Prior Publication Data

US 2016/0288971 A1 Oct. 6, 2016

(51) Int. Cl.
*B25H 3/00* (2006.01)
*B65D 73/00* (2006.01)
*B65D 79/02* (2006.01)

(52) U.S. Cl.
CPC ..... *B65D 73/005* (2013.01); *B25H 3/003* (2013.01); *B65D 79/02* (2013.01)

(58) Field of Classification Search
CPC ..... B65D 5/4208; B65D 73/0064; B65D 73/005; B65D 79/02; B25H 3/00; B25H 6/006; B25H 3/04; B25H 6/003
USPC ..... 206/349, 806, 376, 1.5; 211/70.6; 248/317
See application file for complete search history.

(56) References Cited

U.S. PATENT DOCUMENTS 5,906,350 A * 5/1999 Kao ..... A47F 7/0028 206/349
6,193,200 B1 * 2/2001 Kao ..... B65D 73/0014 206/349
6,679,379 B1 * 1/2004 Kao ..... A47F 5/0006 206/349
6,719,154 B2 * 4/2004 Kao ..... A47F 7/024 206/349
6,732,989 B1 * 5/2004 Kao ..... A47F 5/0006 206/349
6,935,516 B2 * 8/2005 Chiang ..... B65D 73/0064 206/349
7,055,689 B2 * 6/2006 Chen ..... B25H 3/04 206/349
2002/0175257 A1 * 11/2002 Yen ..... A47F 5/0006 248/309.1
2004/0099621 A1 * 5/2004 Chen ..... B65D 73/0014 211/70.6
2004/0173485 A1 * 9/2004 Huang ..... A45F 5/021 206/349
2004/0178096 A1 * 9/2004 Kao ..... B65D 73/0064 206/349
2005/0061757 A1 * 3/2005 Chiang ..... B65D 73/0064 211/70.6
2005/0067307 A1 * 3/2005 Kao ..... B65D 73/0064 206/349

FOREIGN PATENT DOCUMENTS

TW M380069 5/2010

* cited by examiner

*Primary Examiner* — Steven A. Reynolds
(74) *Attorney, Agent, or Firm* — Muncy, Geissler, Olds & Lowe, P.C.

(57) ABSTRACT

A display board for tools includes a main body and a positioning member. The main body includes a first surface and a second surface. The first surface extends to form an extension portion. The extension portion further extends to form an elastic portion. The extension portion and the elastic portion form a hook portion. The positioning member includes a stop portion. The stop portion includes a tail portion extending upwardly. The stop portion is abuttable against the elastic portion to deform the elastic portion so that the tail portion crosses over the elastic portion and abuts against a side of the elastic portion. The positioning member is unmovable relative to the main body via a fixing plug inserting in a fixing hole. A receiving space for a tool to be received therein is formed between the main body and the positioning member.

6 Claims, 6 Drawing Sheets

DISPLAY BOARD FOR TOOLS

BACKGROUND OF THE INVENTION

Field of the Invention

The present invention relates to a display board for tools, and more particularly to a display board for tools with an anti-theft function.

Description of the Prior Art

A prior art of a display board for wrenches or other tools is disclosed in TWM380069. The display board usually includes a main body and a fixing member. A tool is received between the main body and the fixing member. Via a method of irreversible assembly and engagement between the fixing member and the main body, the display board can have an anti-theft function.

However, when a customer buys a tool assembled with the display board, the customer has to use scissors (or other tools) to clip and remove elastic hooks from the display board and then takes out the tool. If the elastic hooks are clipped and removed, the fixing member is unable to be assembled to the main body. In other words, the display board cannot fix and hang the tool if the elastic hooks are clipped and removed, and the display board has to be thrown away. The display board as described above is bad for environment and has too less functions.

The present invention has arisen to mitigate and/or obviate the afore-described disadvantages.

SUMMARY OF THE INVENTION

The primary object of the present invention is to provide a display board for tools. The display board has multiple functions to prevent theft and a reusable structure.

To achieve the above object, a display board for tools in accordance with present invention is provided, including a main body and a positioning member.

The main body includes a first surface and a second surface opposite to each other. The main body defines a horizontal direction, and the horizontal direction is perpendicular to the first surface and the second surface. The first surface of the main body extends toward a direction opposite to the second surface to form an extension portion. A distal end of the extension portion further extending downwardly and obliquely toward the first surface for a predetermined distance to form an elastic portion. The extension portion and the elastic portion form a hook portion.

The positioning member includes a stop portion extending toward the main body. Viewing from a lateral side, the stop portion is substantially L-shaped and includes a tail portion extending upwardly. The stop portion is abuttable against the elastic portion to deform the elastic portion so that the tail portion crosses over the elastic portion and abuts against a side of the elastic portion toward the first surface.

One of the main body and the positioning member is formed with a fixing hole, and the other one is formed with a fixing plug. The fixing plug is insertable in the fixing hole so that the positioning member is unmovable relative to the main body. A receiving space is formed between the main body and the positioning member, and the receiving space is for a tool to be received therein.

The display board for tools of the present invention includes hook structures and limiting structures and is easy to use and assemble. Even if the elastic hooks are clipped and removed, the limiting structures still have a function to position and the display board can still be used as a hanger to hang the tool.

DETAILED DESCRIPTION OF THE PREFERRED EMBODIMENTS

Figure 1:
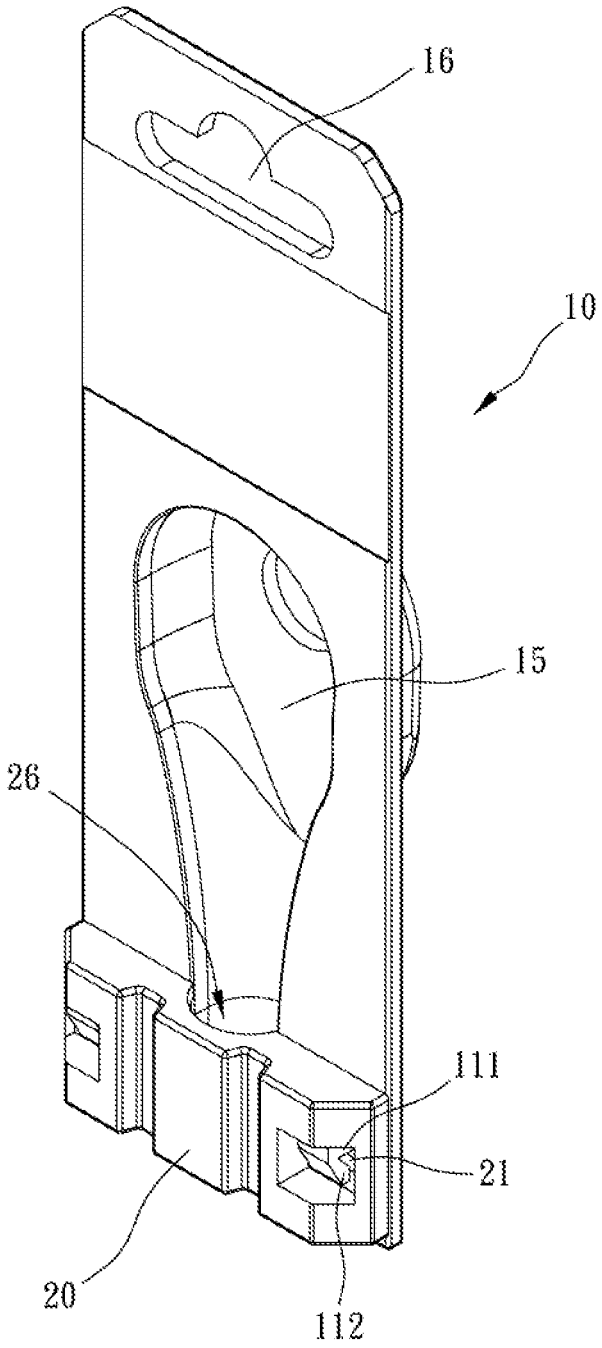
FIG. 1 is a three-dimensional drawing of an embodiment of the present invention.
Figure 2:
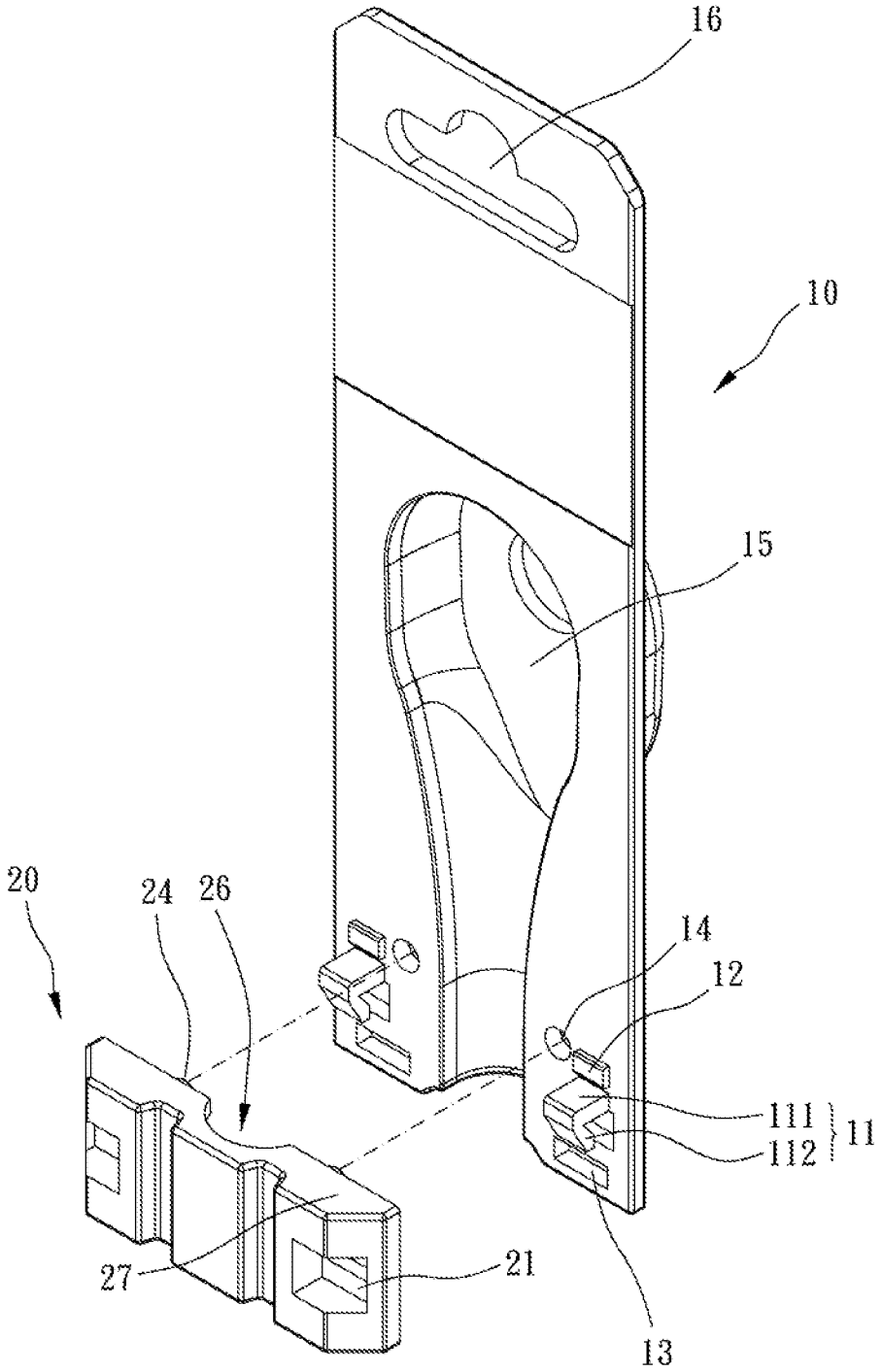
FIG. 2 is a breakdown drawing of the embodiment of the present invention.
Figure 3:
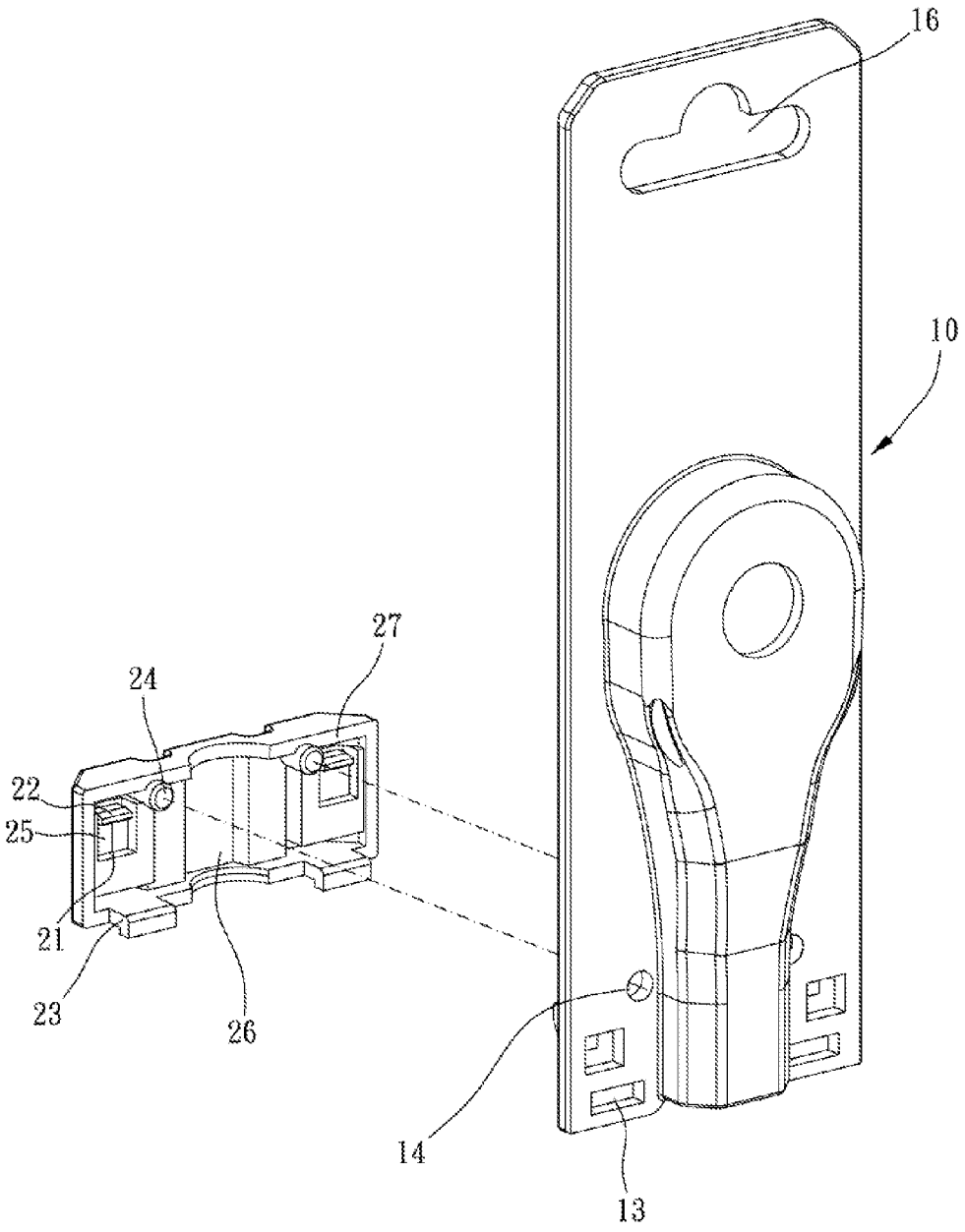
FIG. 3 is another breakdown drawing of the embodiment of the present invention.
Figure 4:
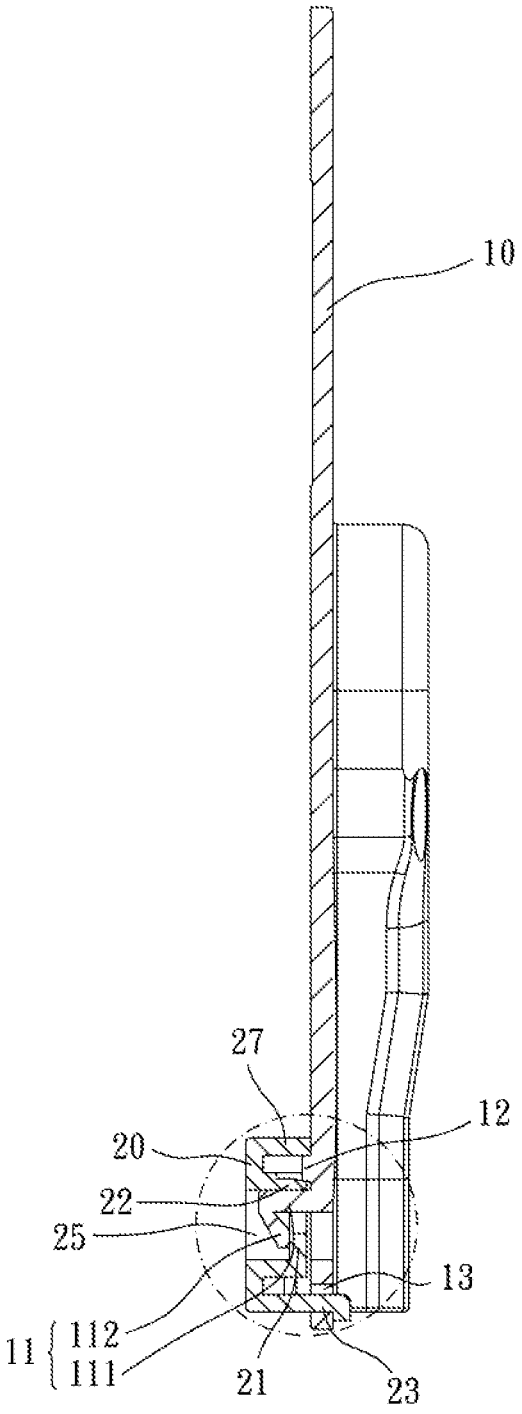
FIG. 4 is a cross-sectional drawing of the embodiment of the present invention.
Figure 5:
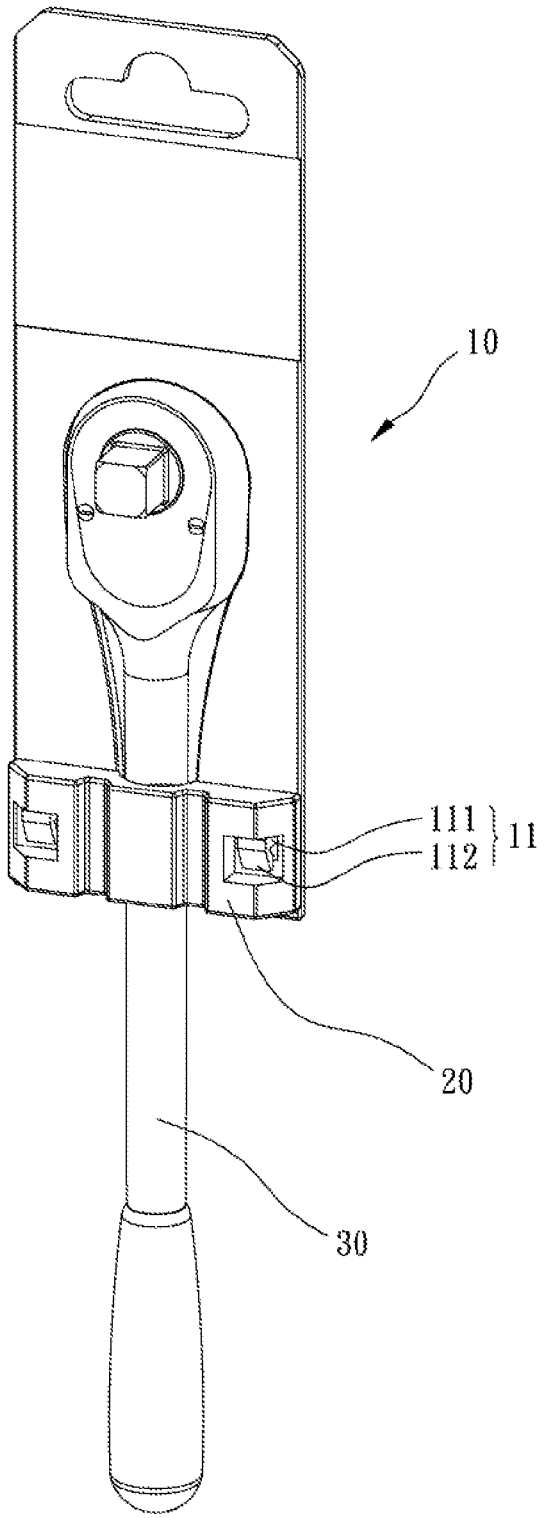
FIG. 5 is a perspective drawing of the embodiment of the present invention in use.

The present invention will be clearer from the following description when viewed together with the accompanying drawings, which show, for purpose of illustrations only, the preferred embodiment in accordance with the present invention.

Please refer to FIGS. 1-8, a display board for tools in accordance with a preferred embodiment is provided, including a main body 10 and a positioning member 20.

The main body 10 includes a first surface and a second surface opposite to each other. The main body 10 defines a horizontal direction, and the horizontal direction is perpendicular to the first surface and the second surface. The first surface of the main body 10 extends toward a direction opposite to the second surface to form an extension portion 111. A distal end of the extension portion 111 further extends downwardly and obliquely toward the first surface for a predetermined distance to form an elastic portion 112. The extension portion 111 and the elastic portion 112 form a hook portion 11. The first surface of the main body 10 is further protrudingly formed with a protrusion 12 on a side of the extension portion 111 opposite to the elastic portion 112. A gap 17 is formed between the protrusion 12 and the extension portion 111. The main body 10 is further penetratingly formed with a positioning hole 13. The positioning hole 13 penetrates through the first surface and the second surface. The main body 10 is formed with a fixing hole 14 on a side of the hook portion 11 remote from the elastic portion 112.

The positioning member 20 includes a stop portion extending toward the main body 10. Viewing from a lateral side, the stop portion is substantially L-shaped and includes a tail portion 21 extending upwardly. The tail portion 21 of the stop portion is abuttable against the elastic portion 112 to deform the elastic portion 112 so that the tail portion 21 crosses over the elastic portion 112 and abuts against a side of the elastic portion 112 toward the first surface. The positioning member 20 is further formed with an insert portion 22. The insert portion 22 is inserted in the gap 17 between the protrusion 12 and the extension portion 111 so that the positioning member 20 is unmovable relative to the main body 10 arbitrarily. Preferably, the positioning member 20 is formed with an abutting wall 27 on a side of the insert portion 22 remote from the stop portion, and the protrusion 12 is engagingly disposed between the insert portion 22 and the abutting wall 27. The positioning member 20 extends to form a hook arm 23, and a free end of the hook arm 23 includes an end portion which extends downwardly and penetrates through the positioning hole 13 to a side of the second surface to clasp a portion near the positioning hole 13. The positioning member 20 is further formed with a fixing plug 24. The fixing plug 24 is inserted in the fixing hole 14 so that the positioning member 20 is unmovable relative to the main body 10 arbitrarily. A receiving space is formed between the main body 10 and the positioning member 20, and the receiving space is for a tool 30 to be received therein.

Figure 6:
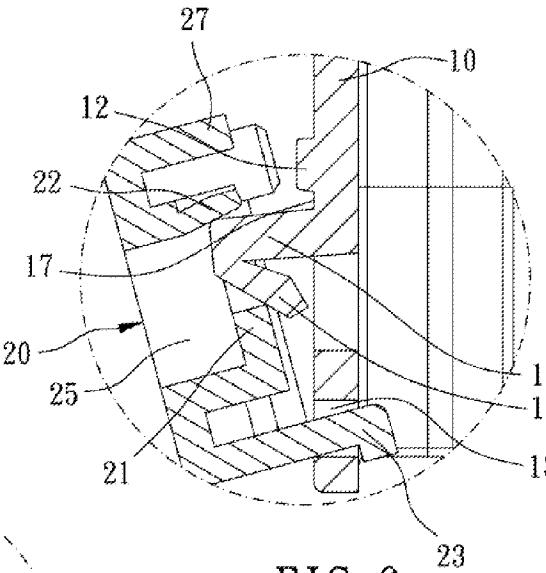
FIGS. 6-8 are partial cross-sectional drawings of the embodiment of the present invention in assembly.
Figure 8:
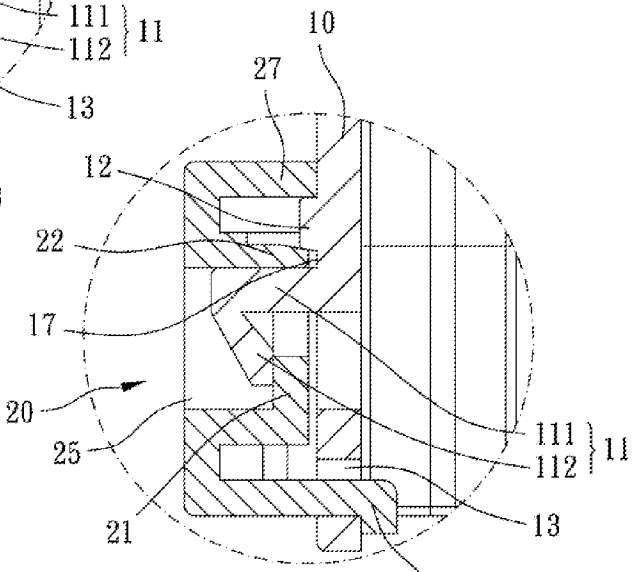
Figure 7:
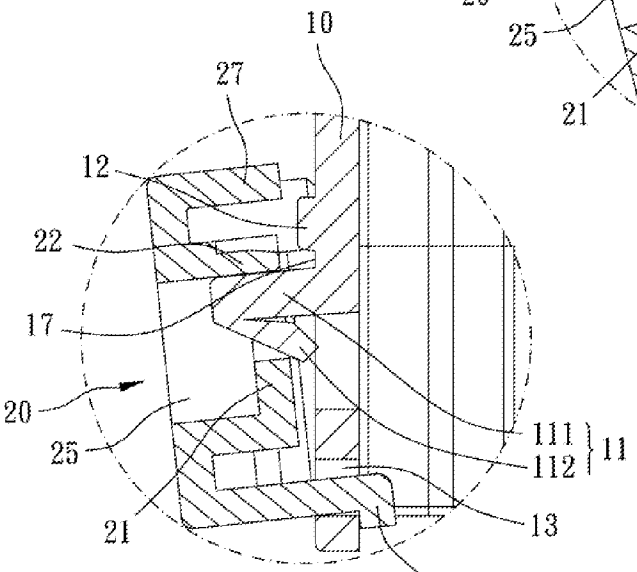

In the present embodiment, the insert portion 22 is lingulate and has slight elasticity. The main body 10 is formed with a receiving slot 15. The positioning member 20 is formed with a receiving concave 26. The receiving concave 26 and the receiving slot 15 correspond to each other and form the receiving space. Preferably, the main body 10 includes two said hook portions 11, two said protrusions 12, two said positioning holes 13 and two said fixing holes 14. The positioning member 20 includes two said stop portions, two said insert portions 22, two said hook arms 23 and two said fixing plugs 24. Two opposite ends of the receiving space each have one said hook portion 11, one said protrusion 12, one said positioning hole 13, one said fixing hole 14, one said stop portion, one said insert portion 22, one said hook arm 23 and one said fixing plug 24. Two said opposite ends of the receiving space have two symmetric positioning structures. The tool 30 is prevented to be taken out from the receiving space. Furthermore, the main body 10 is further penetratingly formed with a hanging hole 16, and the hanging hole 16 penetrates through the first surface and the second surface. The positioning member 20 is formed with a through hole 25 on a position which is near the stop portion and corresponds to the hook portion 11, and the hook portion 11 is received in the through hole 25. In practical use, the main body 10 and the positioning member 20 are disassembled and separated from each other firstly, and then a tool 30 is received in the receiving slot 15 and the hook arm 23 of the positioning member 20 is inserted in the positioning hole 13 to clasp the main body 10. As shown in FIG. 6, the positioning member 20 is rotated around the hook arm 23 toward the main body 10, and a bottom end of the insert portion 22 abuts against a front end of the extension portion 111. Because the insert portion 22 has the elasticity, the insert portion 22 is slightly pushed upwardly by the extension portion 111. Besides, the tail portion 21 of the stop portion starts to push the elastic portion 112 of the hook portion 11 so that the elastic portion 112 is inwardly and upwardly pushed. Please further refer to FIGS. 7 and 8, the insert portion 22 crosses over the front end of the extension portion 111 and is attached to a top side of the extension portion 111 to enter into the gap 17 between the protrusion 12 and the extension portion 111. The tail portion 21 of the stop portion is finally cross over the deformed elastic portion 112 and moves to a back side of the elastic portion 112. The elastic portion 112 is no longer abutted against the tail portion 21 of the stop portion and resumes an original position to stop in front of the tail portion 21 of the stop portion. The tail portion 21 of the stop portion is unreleasable from a limitation of the elastic portion 112. The positioning member 20 is further unmovable relative to the main body 10 because a upper side and a lower side of the positioning member 20 are limited by the hook arm 23, the insert portion 22 and the fixing plug 24. Via a method as described above, the tool 30 is prevented from being taken out by people who try to disassemble the positioning member 20 and the main body 10.

When a user who buys the tool disassembles and takes out the tool 30 from the display board, the user can use scissors or other tools to enter into the through hole 25 to clip the elastic portion 112, and the positioning member 20 can be removed from the main body 10 so that the tool 30 can be taken out.

Specifically, even if the elastic portion 112 is clipped, the positioning member 20 is temporarily assembled on the main body 10 because of the limitation of the hook arm 23, the insert portion 22 and the fixing plug 24. The display board of the present invention can also be used as a hanger for tools. The display board still has a function after the elastic portion is clipped (unrecoverable damage), and it is practical for using.

As a conclusion, the display board for tools of the present invention has multiple functions to prevent from being stolen and to limit. Even if the display board is unrecoverably clipped, it still has a function to hang and is unnecessary to be thrown away. The display board is multi-function in using and is good for environment.

While we have shown and described various embodiments in accordance with the present invention, it should be clear to those skilled in the art that further embodiments may be made without departing from the scope of the present invention.

What is claimed is:

1. A display board for tools, comprising:

a main body, including a first surface and a second surface opposite to each other, the main body defining a horizontal direction, the horizontal direction being perpendicular to the first surface and the second surface, the first surface of the main body extending toward a direction opposite to the second surface to form an extension portion, a distal end of the extension portion further extending downwardly and obliquely toward the first surface for a predetermined distance to form an elastic portion, the extension portion and the elastic portion forming a hook portion;

a positioning member, including a stop portion extending toward the main body, viewing from a lateral side, the stop portion being substantially L-shaped and including an tail portion extending upwardly, the stop portion being abuttable against the elastic portion to deform the elastic portion so that the tail portion crosses over the elastic portion and abuts against a side of the elastic portion facing the first surface;

wherein one of the main body and the positioning member is formed with a fixing hole, the other one is formed with a fixing plug, and the fixing plug is insertable in the fixing hole so that the positioning member is unmovable relative to the main body;

wherein a receiving space is formed between the main body and the positioning member, and the receiving space is for a tool to be received therein;

wherein the main body is further penetratingly formed with a positioning hole, the positioning hole penetrates through the first surface and the second surface, the positioning member extends to form a hook arm, and a free end of the hook arm includes an end portion which extends downwardly and penetrates through the positioning hole to a side of the second surface to clasp a portion near the positioning hole.

2. The display board for tools as claimed in claim 1, wherein the fixing hole is disposed on a side of the hook portion of the main body remote from the elastic portion, and the fixing plug is disposed on the positioning member.

3. The display board for tools as claimed in claim 1, wherein the main body is formed with a receiving slot, the positioning member is formed with a receiving concave, and the receiving concave and the receiving slot correspond to each other and form the receiving space.

4. The display board for tools as claimed in claim 3, wherein the main body includes two said hook portions and two said fixing holes, the positioning member includes two said stop portions and two said fixing plugs, and each of two opposite ends of the receiving space has one said hook portion, one said fixing hole, one said stop portion and one said fixing plug.

5. The display board for tools as claimed in claim 1, wherein the main body is further penetratingly formed with a hanging hole, and the hanging hole penetrates through the first surface and the second surface.

6. The display board for tools as claimed in claim 1, wherein the positioning member is formed with a through hole on a position which is near the stop portion and corresponds to the hook portion, and the hook portion is received in the through hole.

* * * * *